United States Patent [19]

Gallichan

[11] Patent Number: 4,998,498

[45] Date of Patent: Mar. 12, 1991

[54] KNOCKDOWN SAILBOAT

[75] Inventor: Rejean Gallichan, Drummondville, Canada

[73] Assignee: Gallichan R. & Ass., Inc., Hull, Canada

[21] Appl. No.: 376,675

[22] Filed: Jul. 7, 1989

[51] Int. Cl.[5] ..... B63H 9/04

[52] U.S. Cl. ..... 114/345; 114/354; 114/061

[58] Field of Search ..... 114/39.1, 345, 352, 114/354

[56] References Cited

U.S. PATENT DOCUMENTS

| | | | |
|---|---|---|---|
| 3,473,502 | 10/1969 | Wittkamp | 114/345 X |
| 3,846,858 | 11/1974 | Syfritt | 114/354 |
| 4,136,414 | 1/1979 | Popkin | 114/345 |
| 4,249,276 | 2/1981 | Synderman | 114/345 |
| 4,766,830 | 8/1988 | Kunz | 114/354 X |

*Primary Examiner*—Joseph F. Peters, Jr.
*Assistant Examiner*—Edwin L. Swinehart
*Attorney, Agent, or Firm*—Samuel Meerkreebs

[57] ABSTRACT

A knockdown sailboat adapted to be stowed in a carrying case which includes inflatable hulls, a frame made up of longitudinal sectional tubular members connected securely to spaced-apart lateral tubular frame members, and a telescopic sectional mast stepped to the frame so formed. A carrying case is provided which is made up of two identical halves which serve as deck benches on each respective hull and provide a secure connection between the lateral frame members and the longitudinal frame members. Rigid tubular sectional shroud members are provided between the mast and the frame, and other rigging and spars are provided to make an operable sailboat. All of the spars, masts, and frame can be telescoped and stowed along with the deflated hulls into the carrying case formed by the two halves serving as deck benches.

14 Claims, 6 Drawing Sheets

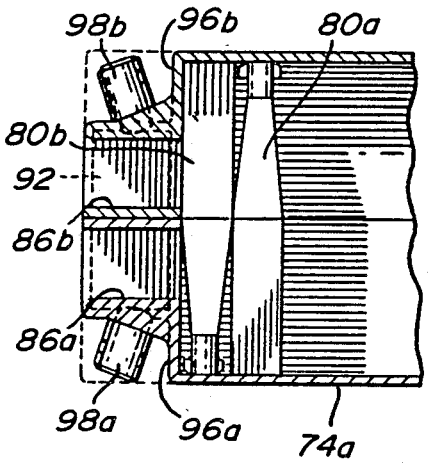
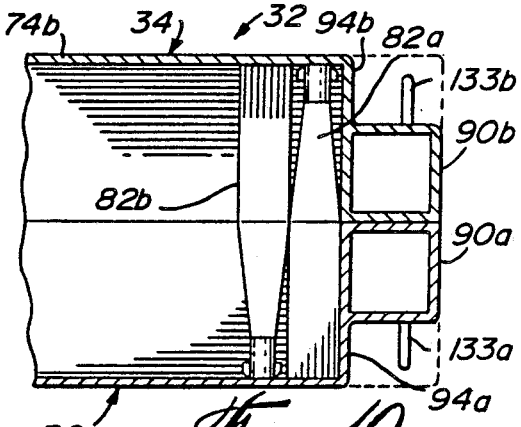
Fig. 10
Fig. 9
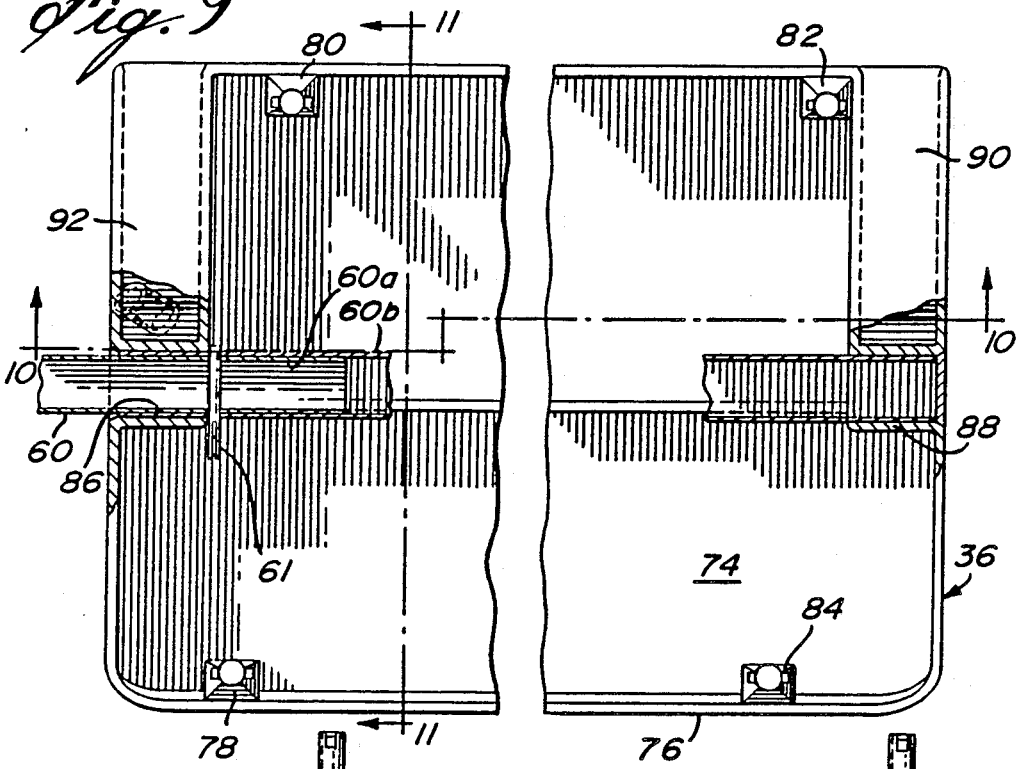
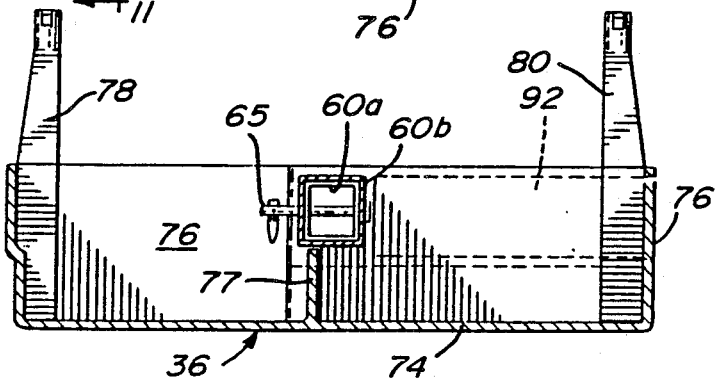
Fig. 11

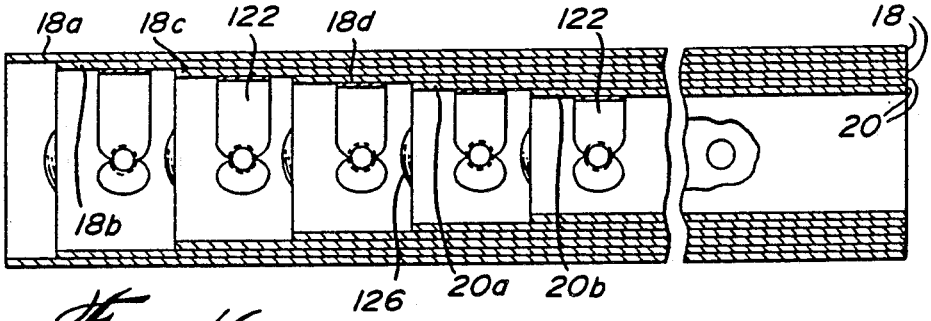
Fig. 14
Fig. 16
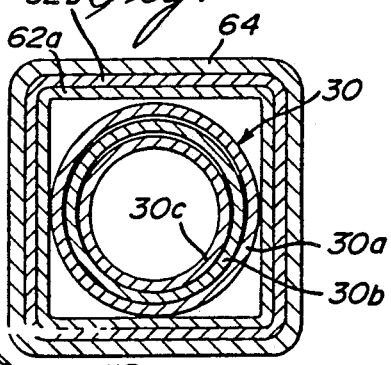
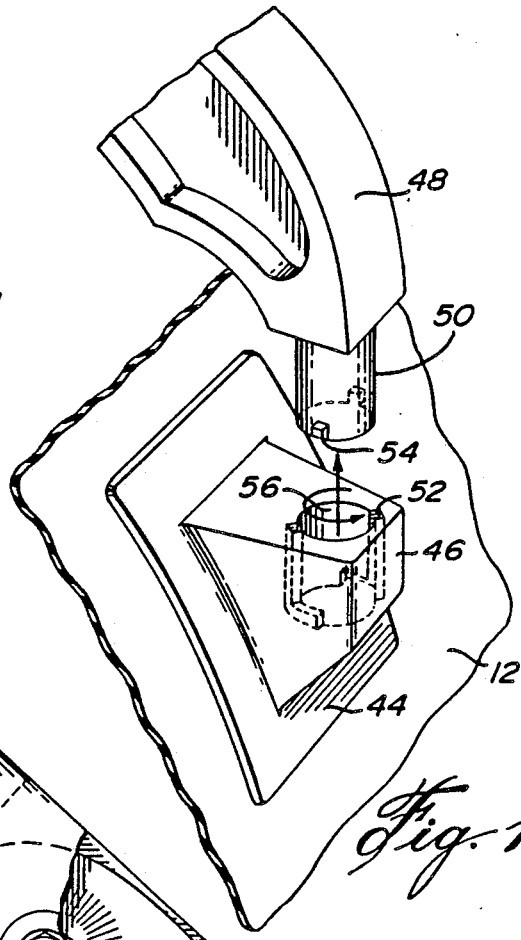
Fig. 12
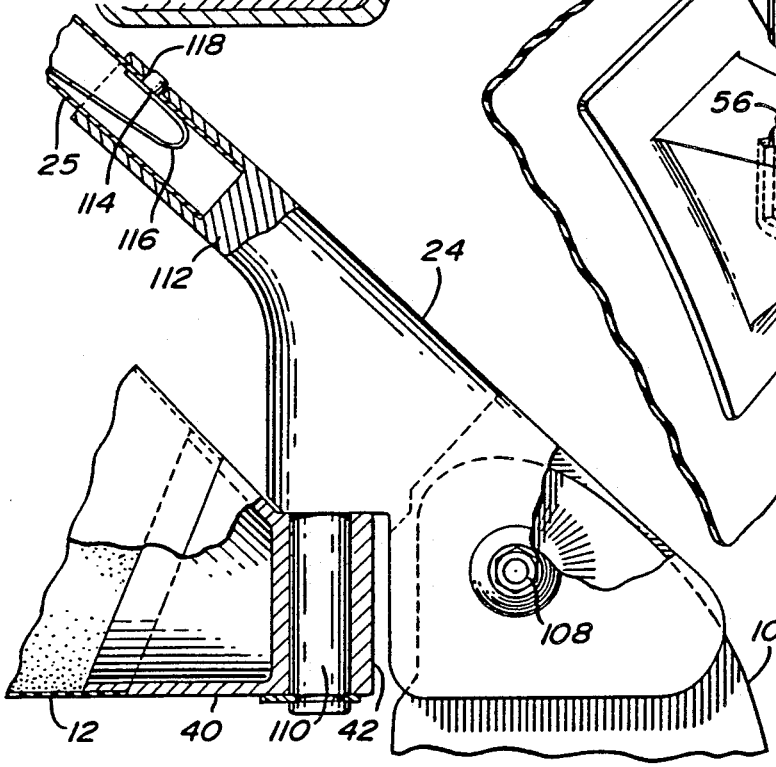
Fig. 13

KNOCKDOWN SAILBOAT

BACKGROUND OF THE INVENTION

1. Field of the Invention

The present invention relates to a knockdown sailboat, and more particularly, to a lightweight sailboat kit which can be readily assembled for use and disassembled for portability.

2. Description of the Prior Art

Relatively lightweight sailboats are available, and such crafts can be easily carried by two persons and roof-mounted on an automobile for easy transport. However, no known sail craft of the 13- ft. to 16-ft. category can be knocked down tot he point of being able to transport it in an automobile trunk, or be easily shipped by air as baggage or even shipped by mail, parcel post, because of size limitations. For instance, a typical solo sailboat, such as "Laser" ® (registered trade mark of Laser International Holdings (1983) Inc.) or a "Sunfish" ® (registered trade mark of A.M.C. Incorporated) has a rigid hull of approximately 14-ft. length and 3.5-ft. beam, which defines the minimum size of the package to which the craft can be reduced even with the possibility of known sectional masts.

SUMMARY OF THE INVENTION

An aim of the present invention is to provide a knockdown sailboat which can be stowed in a carrying case for transport and could be adapted in two packages for shipping as parcel post under current Canadian Postal Regulations, yet can be assembled to provide a sailcraft of comparable size to a "Laser" or "Sunfish" and which can comfortably accommodate a crew of two.

It is a further aim of the present invention to provide a knockdown catamaran sailboat which can be reduced to a package having dimensions considerably smaller than its length and beam when assembled.

A construction in accordance with the present invention comprises a knockdown sailboat assembly consisting of a package in which is provided at least an inflatable hull adapted to be inflated and provide a sailboat hull. Elongated tubular frame members are adapted to be assembled and connected together and to provide at least a mast foot. Anchoring means are provided for anchoring the tubular frame members to the inflatable hull. Rigging, sectional spars, and sails are also provided in the package which is adapted to be assembled with the tubular frame members to form an operable sailboat.

In a more specific embodiment of the present invention, there is provided a knockdown sailboat assembly including a container formed by two identical container members. Within the container are a pair of elongated inflatable hull members adapted to form the hulls of a catamaran when inflated. Also provided within the container are longitudinal and lateral, sectional, tubular frame members adapted to be assembled to form a frame. Anchor means are provided for mounting on each hull in order to receive and fix the frame. A telescopic sectional mast is provided in the container adapted to be stepped on the frame and a sectional boom to be connected to the mast. A center board is provided which is adapted to be slidably mounted on the frame, and rudder means is adapted to be pivotally mounted at the stern of the inflatable hulls. Rigging is also provided in the container. The two container members are adapted to be mounted one on each hull and connected to the frame to provide a deck bench on each hull.

In another aspect of the present invention, there is provided a sailboat comprising at least an inflated hull. A rigid frame is mounted on the inflatable hull to provide at least a mast foot, and anchor means mounts the frame to the hull. The sailboat is provided with a mast stepped on the frame. Rigging, spars, and sails are arranged to form an operable sailboat.

In yet another specific embodiment of the present invention, there is provided a catamaran having a pair of inflated hulls. At least a longitudinal rigid frame member extends along each hull, and lateral rigid frame members extend between and are connected to the longitudinal frame members to form a frame. Anchoring means are attached to the hulls and are connected to the frame to support the frame on the hulls. A mast is stepped to, and a center board is slidably mounted on, the frame between the hulls. A boom is pivotally connected to the mast and rigging extends between the frame and mast. Rudders are pivotally mounted to the stern ends of the hulls.

Thus, the present invention provides a novel lightweight sailboat using inflatable hulls and a rigid frame for mounting the spars and rigging to the inflatable hulls. By providing inflatable hulls and sectional spars, the sailboat can be knocked down into a relatively small package and, in a particular embodiment, can be stowed in a carrying case which can qualify as accompanying luggage on an aircraft, or can be transported in the trunk or at least on a carrying rack of most automobiles. The sailboat can be assembled with relative ease from the kit provided in the carrying case, which would also include a portable air compressor of the type which can be run off an automobile or any 12 volt source.

BRIEF DESCRIPTION OF THE DRAWINGS

Having thus generally described the nature of the invention, reference will now be made to the accompanying drawings, showing by way of illustration, a preferred embodiment thereof, and in which:

FIG. 9 is a fragmentary top plan view, partly in cross-section, of only the bottom tray of the carrying case shown in FIG. 1;

FIG. 10 is a fragmentary vertical cross-section of the complete carrying case, taken along line 10—10 of FIG. 9;

FIG. 11 is a vertical cross-section, taken along line 11—11 of FIG. 9;

FIG. 12 is a fragmentary enlarged exploded perspective view of a detail of the present invention;

FIG. 13 is an enlarged fragmentary side elevation, partly in cross-section, of a detail of the present invention;

FIG. 14 is a longitudinal cross-section of the mast and boom in a telescoped stowed condition;

FIG. 16 is a radial cross-section of a telescoped shroud stowed within a telescoped longitudinal frame member which, in turn, is stowed within a lateral frame member.

DESCRIPTION OF THE PREFERRED EMBODIMENTS

Figure 1:
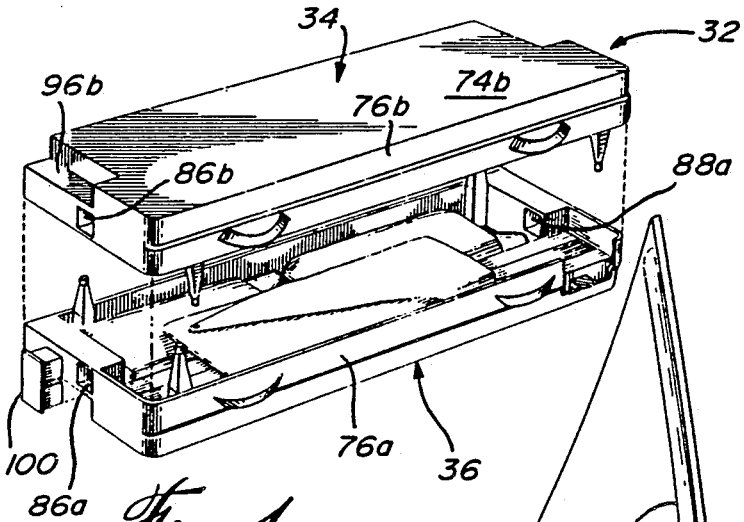
FIG. 1 is a perspective exploded view of a carrying case containing the sailboat kit in accordance with the present invention.

Referring now to the drawings, there is illustrated, in FIG. 1, the knockdown sailboat stowed in a carrying case 32 made up of two identical halves 34 and 36 which serve as the tray and lid of the container or carrying case 32. Within the case, and barely perceptible, are stowed the various elements which make up the sailboat 10, as will be described.

To start off with, the sailboat will be described in its fully assembled and rigged condition, after which the knockdown stowed-for-transport condition of the various elements will be described.

Referring now to FIGS. 1 through 4, there is shown an embodiment of the sailboat in the form of a catamaran 10, including inflated hulls 12 and 14. The inflated hulls 12 and 14 are made up of material commonly used in powered inflatable boats which have conventionally been used as life rafts on larger boats and have become a more popular form of motorized transportation. The inflatable hulls 12 and 14 are cylindrical tubes made up of a woven fabric, such as polyester impregnated with a rubber-like material such as PVC. In the present case, the tubes are formed as elongated webs and then closed by electronic welding. Each hull 12 and 14, in the present embodiment, is 13 feet in length by 13½ inches.

Figure 7:
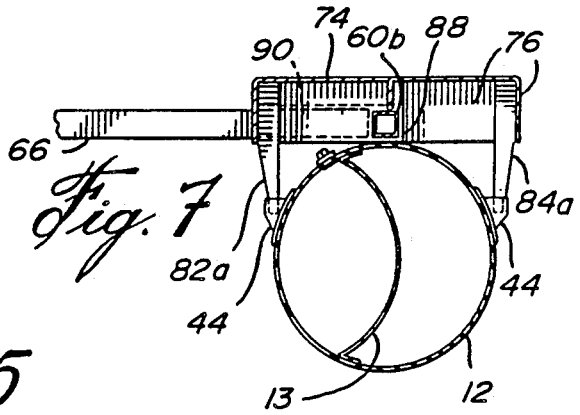
FIG. 7 is a fragmentary vertical cross-section, taken along line 7—7 of FIG. 3.
Figure 8:
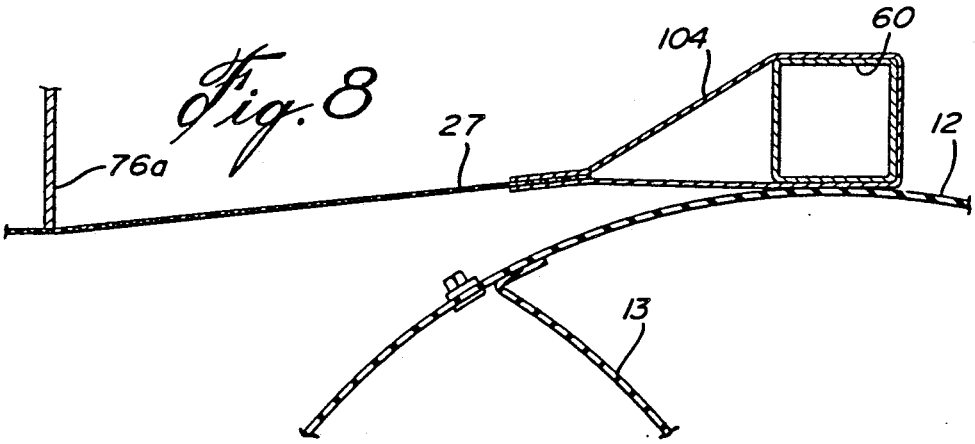
FIG. 8 is an enlarged detailed cross-section, taken in the same plane as FIG. 7, and showing a specific detail thereof.

As shown in FIGS. 7 and 8, a further web 13 is welded on the webs before they are closed so as to form a second chamber within the hull for safety purposes. The web 13 need not be an impregnated fabric material but could be a thin PVC membrane.

Referring back to FIGS. 2, 3, and 4, the sailboat includes a rigid frame 16 mounted on the relatively flexible inflatable hulls 12 and 14, and the frame 16 supports the various spars and rigging requirements of a typical catamaran sailboat. Thus, a mast 18 is stepped on the frame 16, and a boom 20 is pivotally connected through a universal connection to the mast 18. The boom 20 and mast 18 subtend a sail 22. Rigid spars 28 and 30 extend between the frame 16 and the mast 18. At the stern of each hull, there is provided a rudder 24 pivotally mounted thereon and controlled by a common tiller 25 as will be described.

A deck 27 in he form of a net extends tautly between the various frame members, and the two carrying case halves 34 and 36 serve as deck benches, as shown in these drawings. The deck benches or carrying case halves 34 and 36 are integrated to the frame 16.

Finally, a center board 26 is slidably mounted to the frame 16 between the hulls 12 and 14.

The bows of the hulls 12 and 14 are provided with bow caps 38*a* and 38*b* at the end of the upwardly tapered bows. The bow caps 38*a* and 38*b* serve as bumpers in order to protect the material of the hulls. Stern caps 40*a* and 40*b* are provided at the respective sterns of the hulls 12 and 14. As seen in FIG. 13 and as will be described later, the stern caps 40*a* and 40*b* are made of a relatively hard plastics material and are provided with sleeves 42 for receiving and mounting the respective rudders 24*a* and 24*b*.

Referring to FIGS. 2 through 7, the frame 16 will now be described in more detail.

A pair of longitudinal sectional frame members 60 and 62 extend axially of each hull 12 and 14. These frame members 60 and 62 are sectional and are made up of telescoped parts of square cross-section. Each part 60*a* and 60*b* and corresponding part 62*a* and 62*b* are shown in full extension in FIG. 3 and are locked by locking pins 65, as shown in FIGS. 9 and 11. End caps 61 and 63 are provided to the fore end of longitudinal frame members 60 and 62 respectively and are meant to protect the fabric of the hulls 12 and 14 as well as to press the bows downwardly as the hulls are pressed upwardly by waves against the ends of the frame members 60 and 62.

Figure 5:
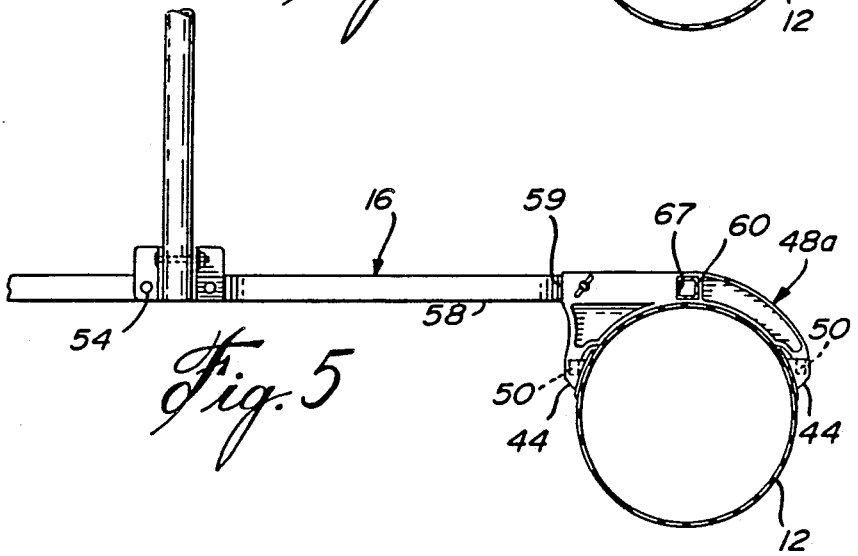
FIG. 5 is a fragmentary vertical cross-section, taken along line 5—5 of FIG. 3.

The longitudinal frame members 60 and 62 are connected to each of the hulls 12 and 14 by means of anchor saddles 48*a* and 48*b*. Referring to FIGS. 5 and 12, anchor saddle 48*a* is shown, saddling the hull 12. Each of the anchor saddles 48 are anchored to anchor seats 44 welded directly to the outer surface of the hulls at selected positions. In the case of anchor saddle 48*a*, there is provided an anchor seat 44 on either side of the hull 12 adapted to receive the ends of the anchor saddle 48*a*. As shown in FIG. 12, the connection of the end of the saddle 48 and the anchor seat 44 is a bayonet connection.

For instance, saddle 48 is provided with a cylindrical projection 50 having diametrically opposed lugs 54. The anchor seat 44 is provided with a female bore 56 having bayonet grooves 52 at an angle to the plane of the lugs 54. Thus, before the saddle 48 can be anchored to the anchor seat 44, the anchor seat 44 must be turned so that the grooves 52 are in the plane of the lugs for engagement therewith and only when the lugs 54 are at the bottom end of the grooves 52 will the anchor seat 44 be allowed to rotate relative to the saddle. The hulls 12 and 14 must be underpressured in order to allow the anchor seat 44 to be manipulated. Since a similar projection 50 is provided at the other end of the saddle adapted to engage a similar anchor plate 44, as shown in FIG. 5, the anchor seat 44 twisted against a not too inflated hull 12 so as to allow projection 50 on the inboard side of the hull to likewise engage in the anchor seat 44. The lateral frame member 58, which has a square tubular cross-section, is adapted to engage and nest in an elongated socket 59 and defined within the saddle 48. A saddle 48*b* is provided on the hull 14 and is mounted in a similar manner to saddle 48*a* on hull 12. Likewise, the lateral frame member 58 will engage a similar socket in the saddle 48*b*. It is important that these frame connections be made so as to resist torsional forces. The frame provides the stability to the sailboat and must not twist or at least reduce such twist to a minimum. Suffice it to say that the frame must provide the same degree of rigidity and flexibility as the frame of a typical rigid catamaran of similar size.

The saddle 48*a* is also provided with a central bore 67 of square cross-section adapted to receive the frame member 60 and, of course, saddle 48*b* has a similar bore to receive the frame member 62. The shape of these openings or bores 67 allows the longitudinal frame members 60 and 62 to be rigidly secured relative to the lateral frame member 58 and to be prevented from rotation along its respective axis.

The ends of the lateral frame members 58, for instance, are tight fitted into the sockets 59 or can be provided with suitable locking devices.

Figure 3:
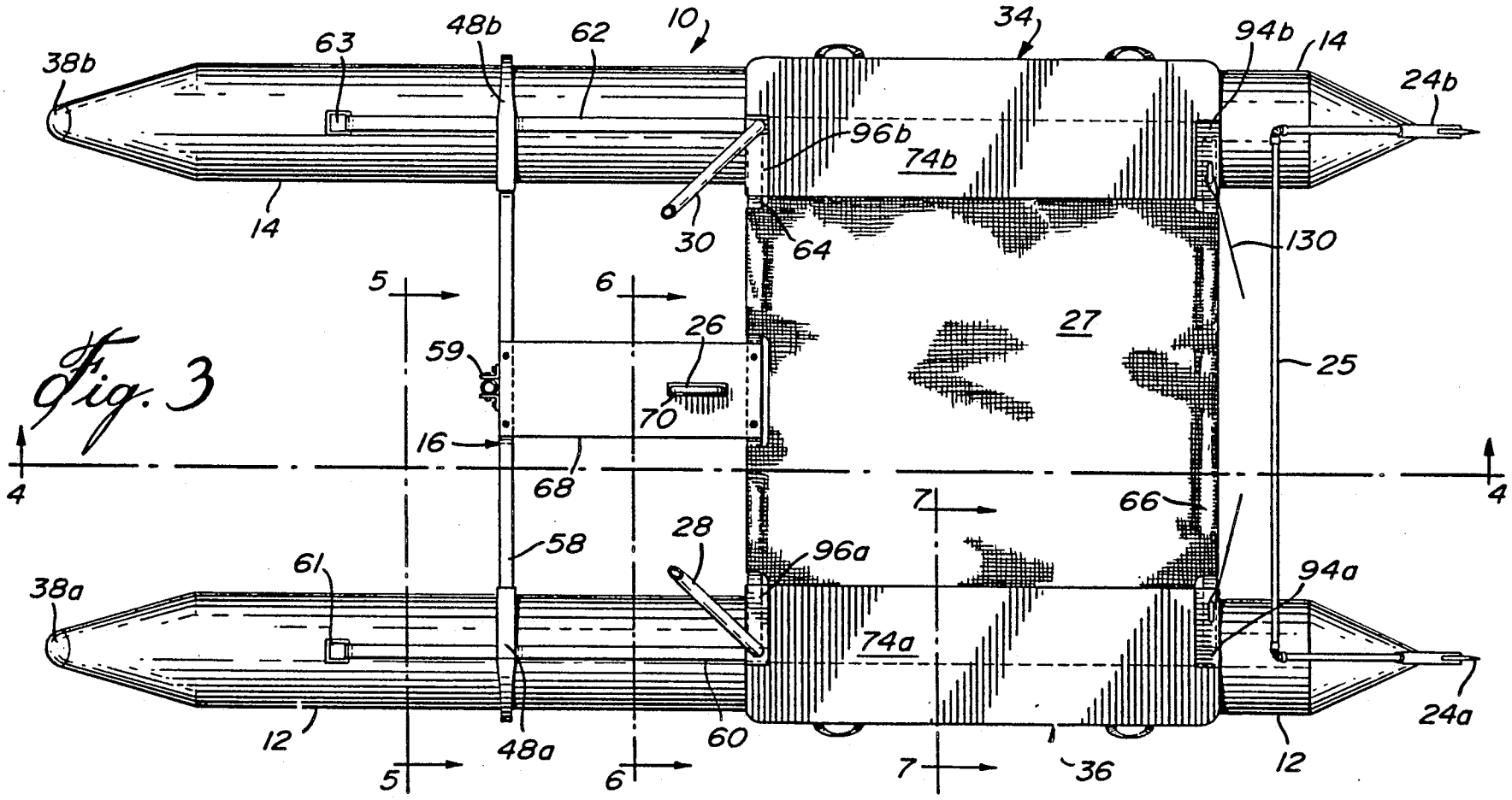
FIG. 3 is a top plan view of the sailboat shown in FIG. 2.
Figures 4, 17:
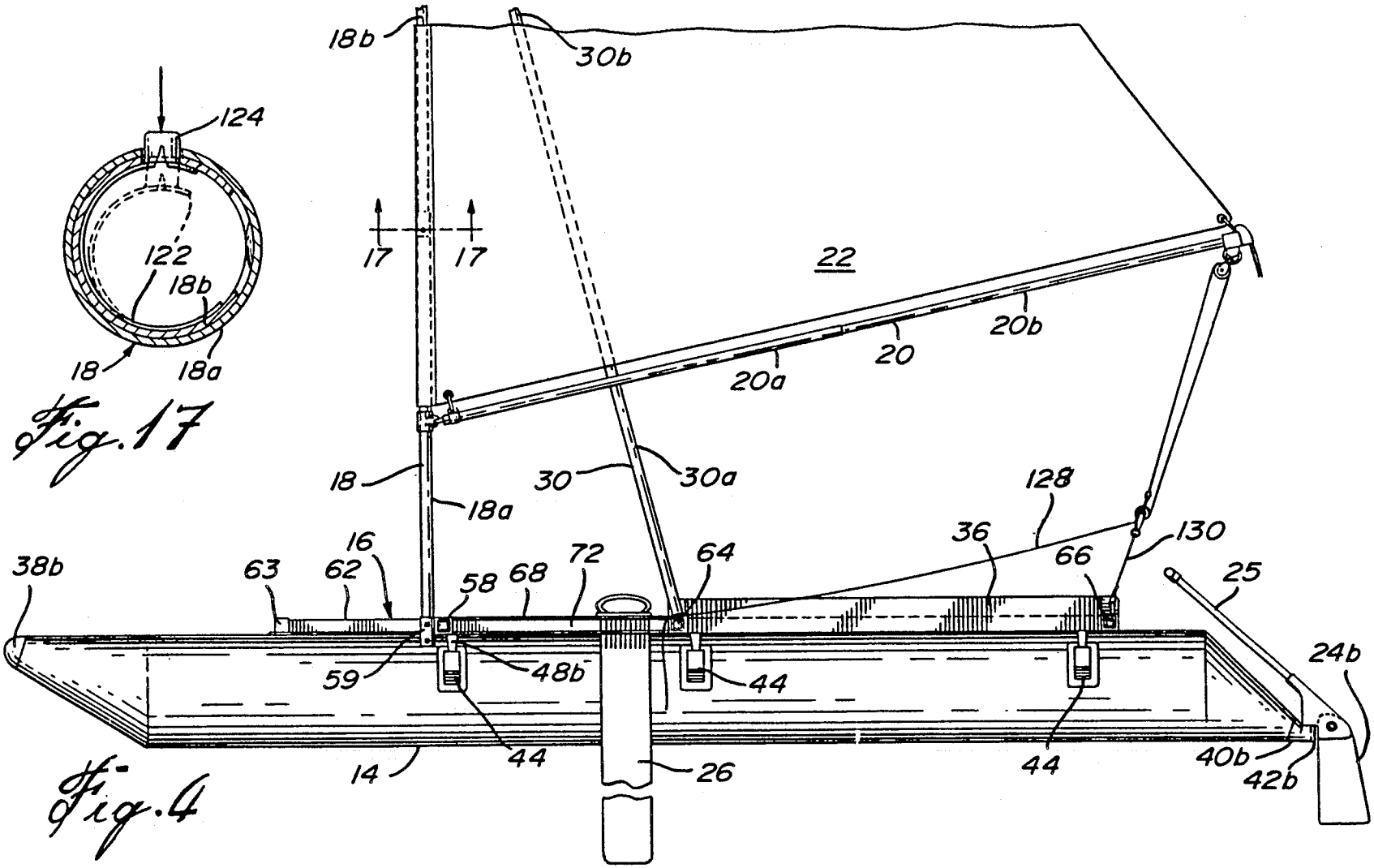
FIG. 4 is a vertical cross-section, taken along line 4—4 of FIG. 3.
FIG. 17, which is on the same sheet of drawings as FIG. 4, is a radial cross-section, taken along line 17—17 of FIG. 4.
Figure 15:
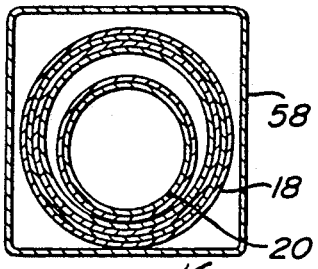
FIG. 15 is an end elevation of a lateral frame member in the telescoped spars of FIG. 14 have been stowed.
Figure 6:
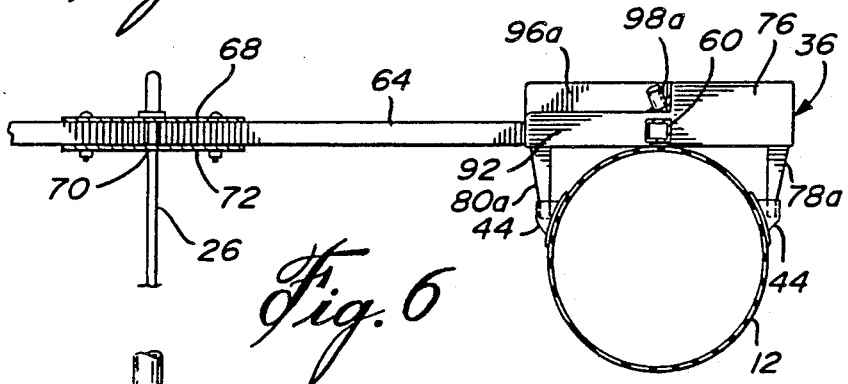
FIG. 6 is a fragmentary vertical cross-section, taken along line 6—6 of FIG. 3.

A lateral frame member 64 is connected to deck bench members 34 and 36 in a manner similar to frame member 58 in saddles 48*a*, 48*b*, as will be described in more detail. A pair of parallel plates 68 and 72 are bolted to the lateral frame members 64 and 58, as shown in FIGS. 3 and 6, for the purpose of slidably mounting the dagger board or center board 26. Longitudinal slots 70 are defined in the plates 68 and 72 in a vertical alignment and serve as the center board well. A lateral frame member 66 extends between the ends of the deck benches 34 and 36 and are connected therewith, as will be described later. Thus, frame 16 is made up of lateral frame members 58, 64, and 66 rigidly connected to longitudinal frame members 60 and 62 which, in turn, are anchored to the hulls by anchor seats 44.

The deck benches 34 and 36 are, in fact, the carrying case halves and are provided with legs 78, 80, 82, and 84. These legs must be slightly staggered since the two halves 34 and 36 are identically constructed and must nest together. For clarity, the respective legs 78, 80, 82, and 84 have been provided with subscripts "a" and "b" in FIG. 10 in order to properly identify them. For instance, those legs having subscript "b" are fixed to the floor 74*b* of the carrying case half 34. Likewise, the legs having subscript "a" are fixed to the base 74*a* of the carrying case half 36.

FIGS. 9 and 11 show the carrying case half 36. The carrying case half 36 has a base 74*a* and upstanding side walls 76 about the periphery thereof. At each end of the carrying case half, there is provided sockets 90 and 92 molded therein and adapted to receive the ends of the lateral frame members 64 and 66 as previously discussed. For the purpose of mounting other rigging elements, the carrying case halves 34, 36 are recessed at 94 and 96 (again raised by subscripts "a" and "b") above each socket 90 and 92. In the case of recess 96, there is an angled upward anchor projection 98 which is adapted to receive the ends of the tubular shrouds 28 and 30. Hooks 133 are also provided to anchor the traveller cable 130, as shown in FIG. 2.

Each of the legs 78 through 84 have bayonet-like projections at the ends thereof which are adapted to engage in individual anchor seats 44 provided on the hulls 12 and 14 in areas adapted to receive the deck benches 34 and 36. The legs 78, 80, 82, and 84 are likewise mounted to these anchoring seats 44 by keeping the hulls 12 and 14 slightly deflated in order to allow the anchor seats to be slightly deflected to receive the bayonet connections.

Figure 2:
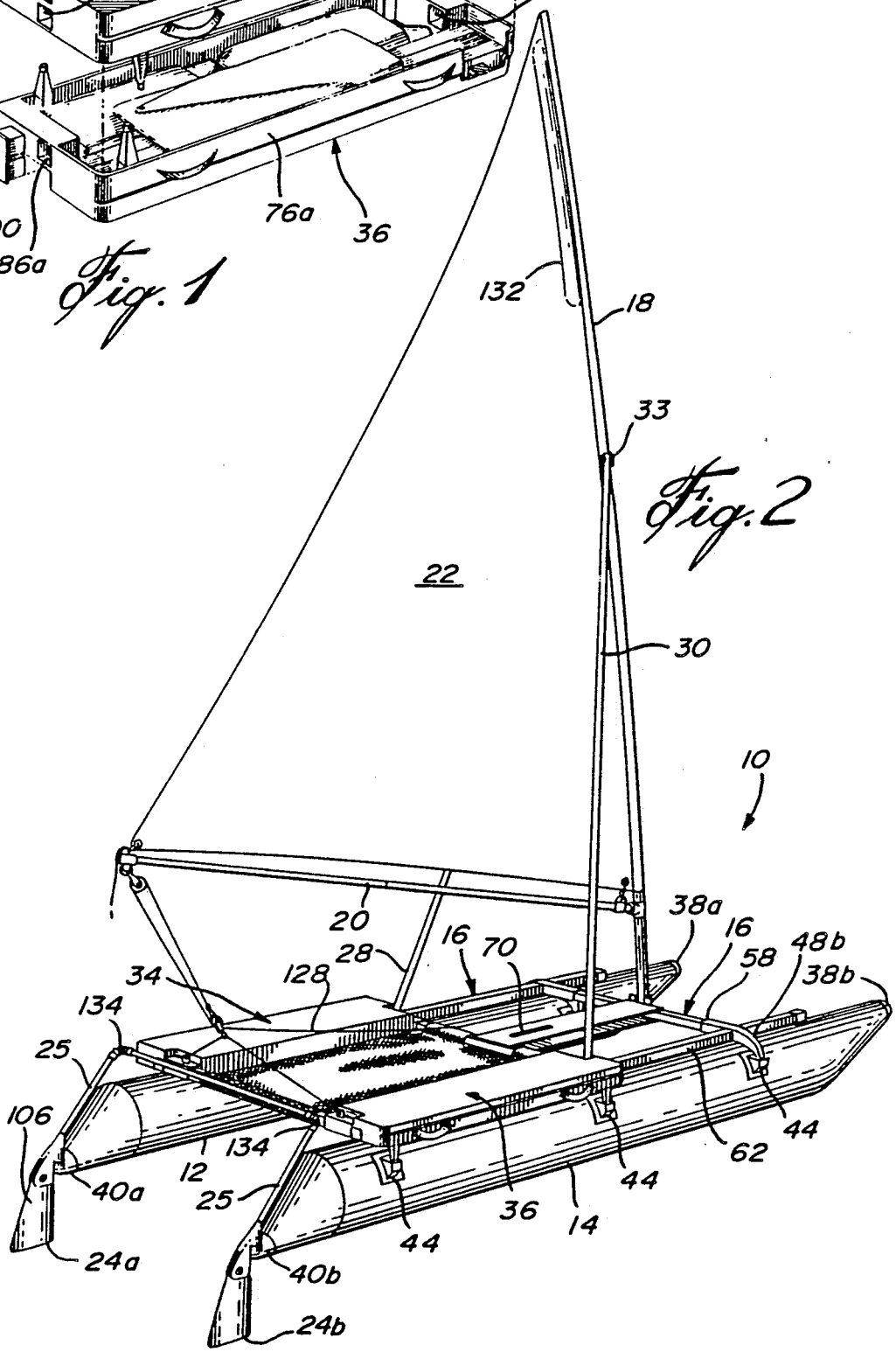
FIG. 2 is a perspective view of the sailboat in an assembled, ready-to-use, position.

Thus, when the carrying case halves 34 and 36 adopt their role as deck benches 34 and 36, as shown in FIGS. 2 and 3, they receive within the respective sockets 90 and 92 lateral frame members 66 and 64 respectively and are, in fact, rigidly connected to the hulls, as shown in FIGS. 6 and 7.

A typical catamaran net forming the deck 27 is mounted to these frame members 66 and 64 as well as to the longitudinal frame members 60 and 62 which extend within the deck benches 34 and 36, as shown in FIGS. 9 and 11. A sleeve 104 is formed at the edges of the net 27 in order to receive the frame member 60, for instance.

As mentioned earlier, the longitudinal frame members 60 and 62 extend within the deck bench members 34 and 36. A bore of square cross-section 86 is provided at the fore of each of the deck benches, and a socket 88 is provided in the aft portion thereof. Longitudinal frame members 60, including its parts 60*a* and 60*b*, extend through the bore 86 and are seated in the socket 88. The deck bench member 36, in this case, provides a rigid structural connection between the longitudinal frame member 60 and the lateral frame members 64 and 66. A plug 100 is provided to be inserted in both openings 86*a* and 86*b* when the halves 34 and 36 are together to form the carrying case 32.

The mast 18 is stepped in a mast foot 54 in the form of a bracket mounted on the lateral frame member 58.

Rigid tubular shrouds 28 and 30 extend from the fore portion of the deck benches 34 and 36 on projections 98*a* and 98*b*, shown in FIG. 10. The shrouds 28 and 30 are connected by means of a bracket 33 to the mast 18.

Each of the rudders 24*a* and 24*b* include rudder blades 106 pivotally connected by means of a pivot bolt and nut 108 into the rudder holder 24 having a pivot pin 110 journalled in the sleeve 42 on the stern cap 40. The rudder includes a board portion to receive the tiller 25. The bore is shown in FIG. 13 and includes a spring locking pin 114 with a leaf spring 116 within the bore of the tiller 25. The tiller 25 has flexible coupling members 134 which allows the tiller 25 to flex as it is being steered. A suitable main sheet 128 passing through pulleys and connected to a flexible cable traveller 130 is also provided.

A feature of the present invention is that the sailboat is a knockdown sailboat and can be stowed in the carrying case 32. Thus, the mast is made of a telescopic sectional tube. In the present case, the mast has four sections 18*a*, 18*b*, 18*c*, and 18*d*. Each mast section has a C-clip adapted to engage respective openings in a successive section. The mast is made to be telescoped, as shown in FIG. 14. The mast 18 is of circular cross-section, and each section is prevented from telescoping to the end of the preceding section by dimples 126 provided near the ends of the walls thereof just preceding the C-clips 122.

Also shown in FIG. 14 is the telescoped boom 20. Boom 20 has two telescoping cylindrical tube sections 20*a* and 20*b* adapted to be telescoped one within the other and then to be inserted in the telescoped mast sections 18. Thus, the boom and the mast form but one short section to be stowed in the carrying case 32. All of the telescoping sections are chosen to have suitable diameters and clearances. Boom sections 20*a* and 20*b* are likewise retained in their extended position by means of C-clips 122.

Each longitudinal frame member 60 and 62 is made up of two parts 60*a* and 60*b* and parts 62*a* and 62*b*, and as previously discussed, are held in an extended position by means of locking pins 65, as shown in FIG. 11. However, when the locking pins are removed, the longitudinal frame members 60 and 62 can be respectively telescoped. For instance, sections 62*a* and 62*b* can be telescoped within the lateral frame member 64, as shown in FIG. 16.

Likewise, a spar 30 is made up of three telescoped sections 30*a*, 30*b*, and 30*c*, and these can be telescoped one into the other and then stowed within telescoped sections 64, 62*a*, and 62*b*. The shroud sections 30*a*, 30*b*, and 30*c* are provided with C-clip locking devices are shown in the mast and boom. Although not shown, the shroud 28 can be telescoped and fitted into the telescoped longitudinal frame member 60 which, in turn, can be inserted within the lateral frame member 66.

The hulls 12 and 14 can be deflated and folded neatly to be inserted into the carrying case 32 along the sail 22. The rudders 24*a* and 24*b* as well as the tiller can be knocked down and stowed in the carrying case with the center board and the center board plates 68 and 72.

Very few fastening devices are required to assemble the sailboat and, in fact, all of the spars as described have snap C-clips to hold the spars in their elongated extended position. Likewise, the frame members are connected together as previously described along with the carrying case halves 34 and 36.

The result is a practical, lightweight sailboat which can be collapsed into a package much smaller than the length of the hulls.

I claim:

1. A knockdown catamaran assembly wherein the assembly includes a package in the form of a container formed by two identical container halves; within the container there is provided a pair of elongated inflatable hull members adapted to form the catamaran assembly when inflated, longitudinal and lateral sectional tubular frame members adapted to be assembled to form a frame, anchor means within the container to be mounted on each hull member in order to receive and fix the frame and anchor it to the hull members, a telescoped sectional mast adapted to be stepped on the frame and a telescoped sectional boom being connected to the mast, a center board adapted to be slidably mounted on the frame, rudder means adapted to be pivotally mounted on the stern of the inflatable hull members, and rigging being provided in the container while the two container halves are adapted to be mounted one on each hull member and integrated to the frame to provide deck benches on each hull member.

2. A knockdown catamaran assembly as defined in claim 1, wherein the telescoped sectional mast has a circular cross-section and the telescoped sectional boom has a circular cross-section, the dimensions of the boom being such that they can telescope within the telescoped mast for storage within the container.

3. A knockdown catamaran assembly as defined in claim 2, wherein the telescoped mast and boom can be stowed within one of said hollow lateral frame members.

4. A knockdown catamaran assembly as defined in claim 2, wherein the rigging includes rigid, tubular, sectional shroud members connected to the frame and to the mast, and the longitudinal frame members are telescopic such that the tubular shroud members can be telescoped and each telescoped shroud member can be stowed within a respective telescoped longitudinal frame member.

5. A knockdown catamaran assembly as defined in claim 4, wherein the telescoped longitudinal frame members, including the telescoped shroud member, can each be stowed within one of said tubular lateral frame member.

6. A knockdown catamaran assembly as defined in claim 1, wherein the anchor means includes anchor seats welded to the surface of the inflatable null members at selected locations, rigid anchor saddles being provided on the hull members with means adapted to engage the saddles to the anchor seats on the hull members, the anchor saddles including socket means for receiving the lateral and longitudinal frame members.

7. A knockdown catamaran assembly as defined in claim 6, wherein the container halves are in the form of carrying case halves; include projection means for engaging selected anchor seats on the respective hull members and the carrying case halves include socket means adapted to receive lateral frame members and longitudinal frame members for forming a secure frame with these members when assembled.

8. A knockdown catamaran assembly as defined in claim 7, wherein the anchor seats and anchor means on the anchor saddles include bayonet type connections for engaging one in the other.

9. A knockdown catamaran assembly as defined in claim 1, wherein each inflatable hull member is provided with a bow cap of relatively hard plastics material at the bow thereof and stern caps at the stern of the hull members, the stern caps including vertically extending sleeves adapted to receive a pivot pin of the rudder means.

10. A knockdown multi-hull sailboat assembly consisting of a container formed by two identical container halves, at least a pair of elongated inflatable hull members adapted to form said multi-hull sailboat when inflated, longitudinal and lateral sectional tubular frame members adapted to be assembled to form a frame, anchor means within the container to be mounted on each hull member in order to receive and fix the frame to the hull members, a sectional mast adapted to be stepped on the frame, and a sectional boom connected to the mast, a center board, rudder means and rigging in the container halves are adapted to be mounted one on each of the at least two hull members and integrated to the frame to provide deck benches on the at least two hull members.

11. A knockdown multi-hull sailboat as defined in claim 10, wherein the frame members include at least three spaced-apart lateral tubular frame members extending and connected to the longitudinal frame members, the mast being stepped to the frame and the center board being slidably mounted to the frame between the hulls, the boom being pivotally connected to the mast and the rigging extending between the frame and the mast, the rudder means comprising at least one rudder pivotally mounted to one of the sterns of the hull members and a tiller connecting member connected to the at least one rudder.

12. A knockdown multi-hull sailboat as defined in claim 11, wherein a foremost lateral tubular frame member is connected to the longitudinal frame members by means of an anchor saddle extending laterally over the top portion of the hull members and having means engaging anchor seats on opposite sides of the hull members, the anchor saddle having socket means for receiving the respective ends of the foremost lateral frame member and an opening for receiving the longitudinal frame member in a secure connection.

13. A knockdown multi-hull sailboat as defined in claim 12, wherein he middle of the three lateral tubular frame members and the aft lateral frame member are connected to rigid deck benches, and the deck benches include downwardly extending legs on either side of the respective hull members engaging anchor seats on the hull members and the deck benches are provided with sockets for receiving the respective ends of the middle and aft lateral tubular frame members, and longitudinal openings are provided in the deck benches for receiving the longitudinal frame members to provide a secure connection between the longitudinal frame members and the middle and aft frame members.

14. A knockdown multi-hull sailboat as defined in claim 13, wherein the means connecting the anchor saddle to the anchor seats and the respective downwardly extending legs of the deck benches to the anchor seats on the hull members include bayonet connections.

* * * * *